United States Patent [19]

Prodel

[11] 4,036,391

[45] July 19, 1977

[54] PLASTIC BOTTLE CASE

[75] Inventor: Ulrich Prodel, Bad Salzuflen BRD, Germany

[73] Assignee: Spumalit-Anstalt, Liechtenstein

[21] Appl. No.: 734,741

[22] Filed: Oct. 22, 1976

[30] Foreign Application Priority Data

Oct. 25, 1975 Germany ..... 2547830

[51] Int. Cl.[2] ..... B65D 1/24; B65D 75/00; B65D 85/00

[52] U.S. Cl. ..... 220/21; D9/177; 206/194; 206/427; 217/19

[58] Field of Search ..... 320/21, 22; 217/19, 217/20, 21; 206/203, 194, 427; D9/176, 177, 178, 179, 184; D87/1 R

[56] References Cited

U.S. PATENT DOCUMENTS

| | | | |
|---|---|---|---|
| 1,990,625 | 2/1935 | Sinz et al. | 217/19 |
| 2,404,685 | 7/1946 | Dassichis | 220/21 |
| 2,830,729 | 4/1958 | Brackett | 220/21 |
| 2,886,202 | 5/1959 | Waller | 220/21 |
| 3,499,525 | 3/1970 | Kanter | 220/21 |
| 3,863,759 | 2/1975 | Prodel | 220/21 |
| 3,927,789 | 12/1975 | Prodel | 220/21 |
| 3,986,628 | 10/1976 | Prodel | 220/21 |
| D. 152,906 | 1/1949 | Richards | D9/177 |

*Primary Examiner*—George E. Lowrance
*Attorney, Agent, or Firm*—Robert E. Burns; Emmanuel J. Lobato; Bruce L. Adams

[57] ABSTRACT

A plastic bottle case comprises four side walls, a bottom and a plurality of partitions extending between only two opposite side walls, the partitions having spaced V-shaped laterally projecting portions and a projection extending parallel to the opposite side walls from the apex of each of the V-shaped portions. The partitions and the projections are spaced apart a distance slightly greater than the diameter of bottles to be received in the case. The V-shaped projecting portions and the projections together extend a distance greater than the radius of the bottles but not to the next partition. A bottle carrier adapted to be received in the case has a bottom and opposite side walls, one of the side walls and the bottom being provided with cutouts to receive the V-shaped laterally projecting portions and the projections from the apices of such portions when the bottle carrier with bottles therein is placed between two partitions of the case.

5 Claims, 4 Drawing Figures

PLASTIC BOTTLE CASE

FIELD OF INVENTION

The present invention relates to plastic bottle cases and particularly to such cases adapted to receive individual bottles or bottles packaged in paper, cardboard or plastic carriers.

BACKGROUND OF INVENTION

A plastic bottle case adapted to receive either individual bottles or bottles packaged in carriers is known through DT-AS No. 22 24 866. Such case is provided with partition walls and spacers. The partition walls are so arranged that they provide a compartment for each bottle carrier. In each compartment there is at least one spacer on the bottom of the case. This spacer is so formed that it projects up through an opening in the bottom of the bottle carrier in between the bottles in the carrier. The bottles in the carrier are arranged in two rows. The advantage of this kind of bottle case is that it is suitable for automatically loading with bottles packaged in carriers, for example "six-packs" as well as for automatic unloading of individual bottles. As the spacers in the bottle compartments separate the bottles during transport automatic unloading can be carried out when the case is full or only partly full of empty bottles.

SUMMARY OF INVENTION

It is an object of the present invention to create a plastic bottle case for receiving single row bottle carriers, the ring being provided with spacers so arranged that the bottles during transport cannot strike one another and the partitions being so formed as to provide increased stiffness and strength.

In accordance with the invention, the partitions have spaced V-shaped laterally projecting portions and projections which extend from the apices of the V-shaped portions so as to separate bottles received between the partitions. The projections extend beyond the midpoint of the bottles so as to keep them from bumping one another but not as far as the next partition.

Through this construction the partitions obtain a particular stability. The projections which extend from the apices of the V-shaped laterally projecting portions of the partitions separate the bottles so that they cannot strike one another during transport.

It is advantageous for the projections to be secured to the bottom of the case, thereby further increasing the stability of the construction.

BRIEF DESCRIPTION OF DRAWINGS

The nature and advantages of the invention will be more fully understood from the following description of preferred embodiments illustrated by way of example in the accompanying drawings, in which.

DESCRIPTION OF PREFERRED EMBODIMENTS

Figure 1:
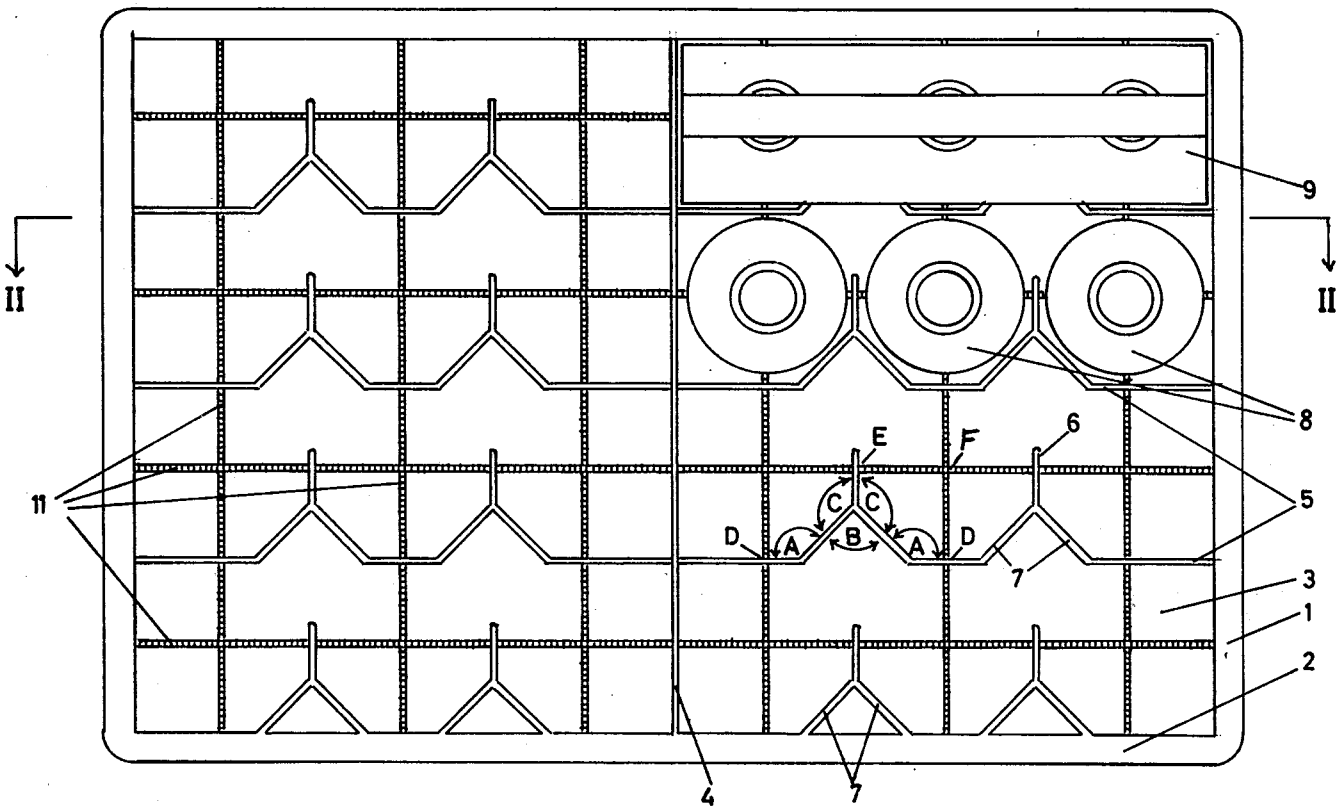
FIG. 1 is a plan view of a bottle case in accordance with the present invention for 24 bottles.
Figure 2:
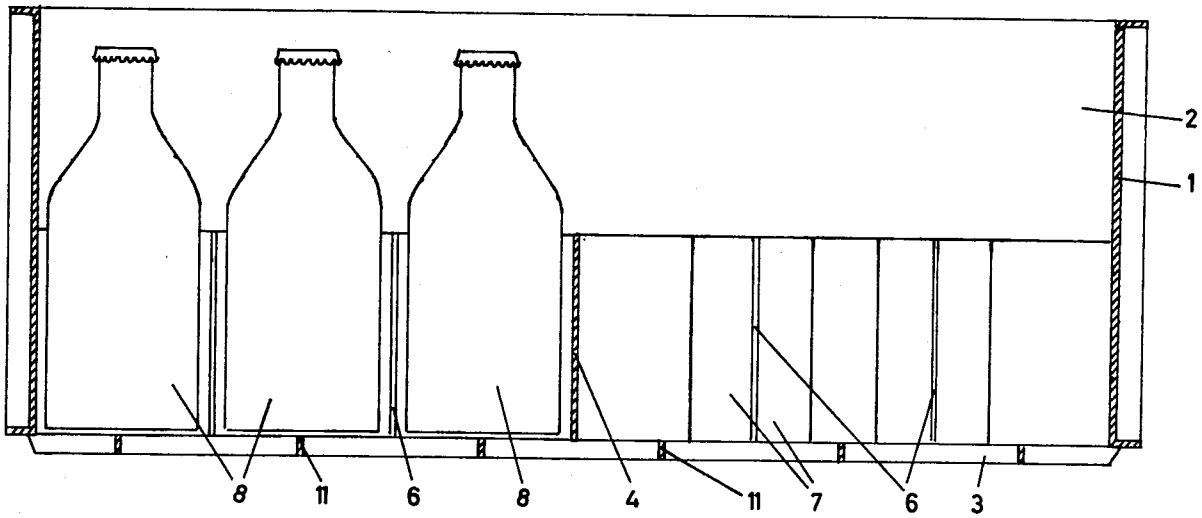
FIG. 2 is a cross section taken approximately on the line II—II in FIG. 1.

The plastic bottle case shown in FIGS. 1 and 2 has two opposite narrow side walls 1 and two opposite wide side walls 2. These side walls are joined with a bottom 3 which can be formed in any desired manner. It can be a continuous flat bottom or it can be formed of a grid or intersecting bars as illustrated in FIG. 1.

The case is divided into two parts by a transverse partition 4 parallel to the narrow sides 1. Each half of the case is then divided by partitions 5 into a plurality of bottle compartments. The partitions 5 have V-shaped projecting portions 7 extending laterally to one side thereof. The two sides of the laterally projecting portion 7 are disposed at an angle A of approximately 135° to adjacent portions of the partition and at an angle B of approximately 90° to one another. A projection 6 extends parallel to the narrow side walls 1 from the apex of each of the V-shaped laterally projecting portions 7. The angle C between the projection 6 and the sides of the laterally projecting portion 7 is approximately 135°. It will be understood that the angles can be changed although it is preferable to have angles approximately as shown in FIG. 1.

Figure 3:
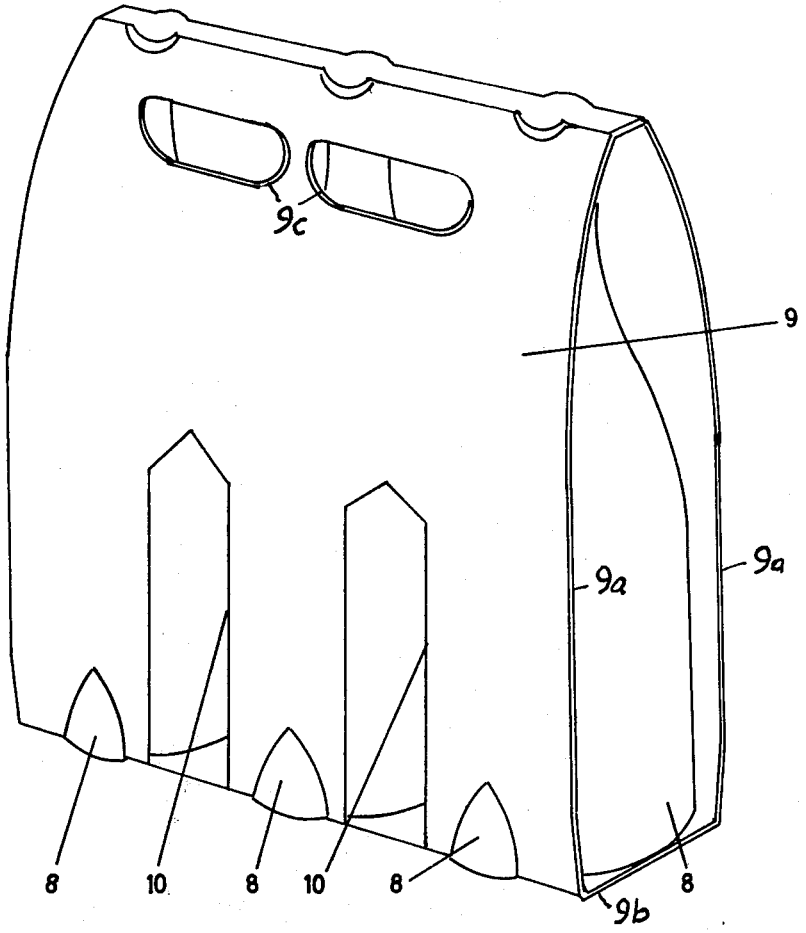
FIG. 3 is a perspective view of a bottle carrier containing bottles and adapted to be received in the bottle case illustrated in FIGS. 1 and 2.

In one of the bottle compartments there are shown three bottles 8. It will be seen that the projections 7 extend beyond the midpoints of the bottles so that the individual bottles in the compartment cannot bump one another during transport. In another compartment there is shown a carrier 9 containing three bottles. As shown in FIG. 3, the carrier 9 comprises opposite side walls **9*a* and a bottom 9*b*. A handle is provided by cutouts 9*c* near the top of the carrier. The bottom and one side of the carrier are provided with cutouts 10 to receive the V-shaped projecting portions 7 and the projections 6** of the case when the carrier with the bottles therein in placed in the case.

In the embodiment illustrated in FIG. 1, the bottom 3 is formed as a grid of crossing bars 11. The bars 11 are so arranged that they cross at points F midway between the partitions 5 and midway between the projections 6 and hence located on the axes of the bottles received in the case. At points D where the bars 11 of the bottom cross the partitions 5, the bottom bars and the partitions are joined with one another. At the points E where the bottom bars 11 cross the projections 6, the projections are joined with the bottom bars. It will be seen that through the joining of the bottom bars, not only with the partitions at the crossing points D but also with the projections at the crossing points E, a particularly strong and stable construction of the casing is achieved. At the same time the angle form of the V-shaped lateral projections 7 of the partitions 5, there is provided an elasticity to lateral strains. In FIG. 1, the bottom bars 11 are shaded so as to differentiate them more clearly from the partitions.

As will be seen in FIG. 2, the partitions 4 and 5 and the projection 6 have a height approximately half the height of the side walls 1 and 2, thereby assuring that the bottles are effectively separated and do not bump against one another during transport. The case is formed as an integral plastic molding.

Figure 4:
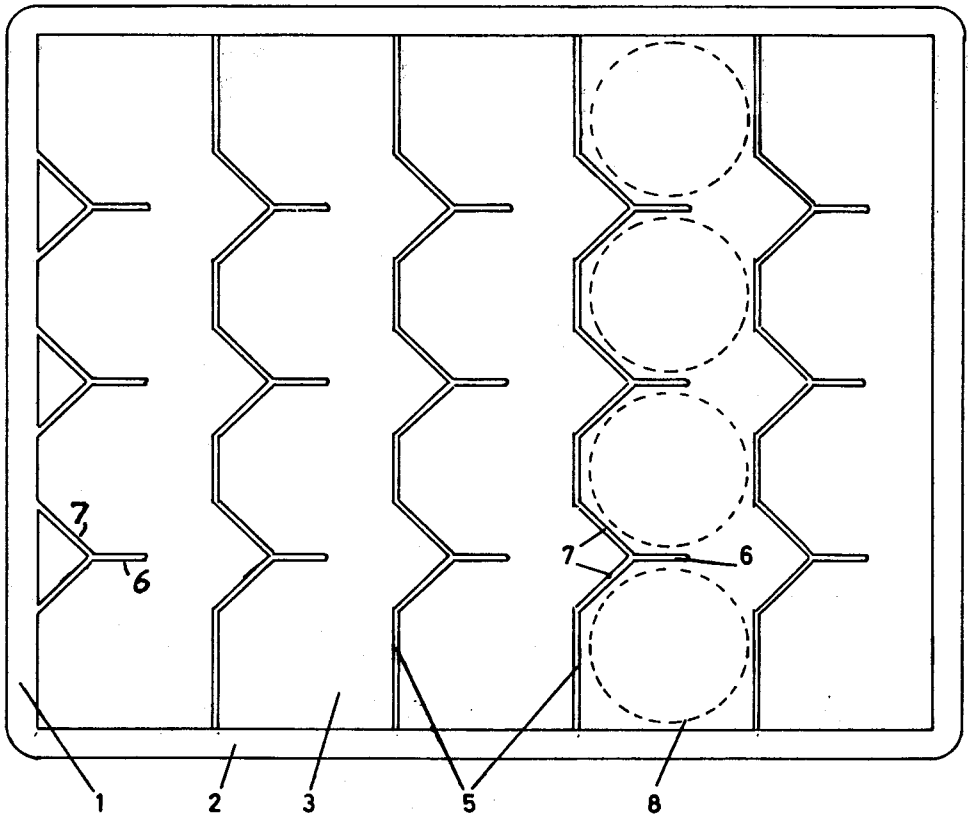
FIG. 4 is a plan view of a bottle case in accordance with the invention for 20 bottles.

In the embodiment illustrated in FIG. 4, there is no transverse partition corresponding to the partition 4 of FIG. 1. Here, there are merely partitions 5 extending between the opposite side walls 2 and formed with laterally projecting V-shaped portions 7 with projections 6 extending therefrom as in FIG. 1. The bottle case shown in FIG. 4 is adapted to receive twenty bottles either individually or in packs of four, each pack being received in a compartment between adjacent partitions or between a partition and a side wall.

As will be seen in FIG. 1, V-shaped projecting portions 7 and lateral projections 6 are provided on one of the side walls 2 so as to separate the bottles in the compartments between the side wall and the next adjacent partition 5. Likewise, in FIG. 4, V-shaped projections 7 and lateral projections 6 are provided on one of the side walls 1 of the case. The bottom of the case as shown in FIG. 4 is a plain flat bottom instead of being formed by crossing bars as in FIG. 1.

While preferred embodiments of the invention have been illustrated in the drawings and are herein particularly described, it will be understood that variations and modifications may be made and that the invention is in no way limited to the illustrated embodiment.

What I claim is:

1. Plastic bottle case comprising four side walls, a bottom, and a plurality of partitions extending between only two opposite side walls, said partitions having spaced V-shaped laterally projecting portions and a projection extending parallel to said opposite side walls from the apex of each of said V-shaped portions, said partitions and said projections being spaced apart a distance slightly greater than the diameter of bottles to be received in said case and said V-shaped projection portions and said projections together extending a distance greater than the radius of said bottles but not to the next partition.

2. Plastic bottle case according to claim 1, in which said projections are secured to the bottom of the case.

3. Plastic bottle case according to claim 1, in which said bottom comprises crossed bars, said bars crossing midway between said partitions and midway between said projections, said partitions and said projections being secured to said bars.

4. Plastic bottle case according to claim 1, in which said V-shaped projecting portions comprising side portions disposed at an angle of approximately 90° to one another.

5. In combination with a plastic bottle case comprising four side walls, a bottom, and a plurality of partitions extending between only two opposite side walls, said partitions having spaced V-shaped laterally projecting portions and a projection extending parallel to said opposite side walls from the apex of each of said V-shaped portions, said projections being spaced apart a distance slightly greater than the diameter of bottles to be received in said case and said V-shaped projecting portions and said projections together extending a distance greater than the radius of said bottles but not to the next partition; and a bottle carrier for a plurality of bottles, said carrier comprising opposite side walls and a bottom, one of said side walls and said bottom of the carrier having therein cutouts to receive said V-shaped projecting portions and said projections which said carrier is placed in said case between two partitions or between a partition and a side wall.

* * * * *